US012582225B1

(12) United States Patent
Yi et al.

(10) Patent No.: US 12,582,225 B1
(45) Date of Patent: Mar. 24, 2026

(54) MULTIFUNCTIONAL CLEANING AND CARE BRUSH WITH MAGNETIC INTERLAYER

(71) Applicant: Yidiandian (Shenzhen) Cultural Media Co., Ltd., Guangdong (CN)

(72) Inventors: Huijuan Yi, Guangdong (CN); Yue Wenyong, Guangdong (CN)

(73) Assignee: Yidiandian (Shenzhen) Cultural Media Co., Ltd., Guangdong (CN)

( * ) Notice: Subject to any disclaimer, the term of this patent is extended or adjusted under 35 U.S.C. 154(b) by 0 days.

(21) Appl. No.: 19/237,684

(22) Filed: Jun. 13, 2025

(30) Foreign Application Priority Data

Dec. 25, 2024 (CN) ..... 202411927947.7

(51) Int. Cl.
*A46B 15/00* (2006.01)
*A46B 5/02* (2006.01)
*A46B 9/02* (2006.01)

(52) U.S. Cl.
CPC ..... *A46B 15/0026* (2013.01); *A46B 5/026* (2013.01); *A46B 9/028* (2013.01); *A46B 2200/1006* (2013.01); *A46B 2200/104* (2013.01)

(58) Field of Classification Search
CPC ..... A46B 15/0026; A46B 5/026; A46B 7/028; A46B 2200/006
See application file for complete search history.

(56) References Cited

U.S. PATENT DOCUMENTS

2020/0260860 A1* 8/2020 Machiorlette ..... A45D 33/36

FOREIGN PATENT DOCUMENTS

CN 220833205 U * 4/2024
CN 119453825 A * 2/2025 ..... A46D 1/02
TW M537840 U * 3/2017

* cited by examiner

*Primary Examiner* — Shay Karls
(74) *Attorney, Agent, or Firm* — Hawaii Patent Services; Nathaniel K. Fedde; Kenton N. Fedde

(57) ABSTRACT

The present disclosure relates to a multifunctional washing and care brush with a magnetic interlayer. To address the issues of inconvenient storage, insufficient structural strength, and single functionality in existing washing and care brushes, the working surface of the main body has an embedded ferrite magnetic filler layer, which can be magnetized to adhere to an iron storage rack, forming a static magnetic field during use to provide magnetic therapy. The operating surface of the main body adopts radial reinforcing ribs and three-dimensional anti-slip protrusions, combined with high-strength materials, to reduce grip deformation and the risk of brush head breakage, optimizing storage convenience and structural strength.

20 Claims, 12 Drawing Sheets

MULTIFUNCTIONAL CLEANING AND CARE BRUSH WITH MAGNETIC INTERLAYER

TECHNICAL FIELD

The present disclosure relates to the technical field of personal care products, particularly to a multifunctional cleaning and care brush with a magnetic interlayer.

BACKGROUND

Existing cleaning brushes face the following technical bottlenecks in terms of storage convenience, connection structural strength, and functional diversity: In storage design, most current cleaning brush products lack integrated storage structures, with handheld brushes typically relying on exposed placement or simple hanging holes, making them prone to slipping or tipping due to wet surfaces after use, while bristles directly exposed to humid environments foster bacterial growth.

In terms of connection strength, traditional cleaning brush structures lack reinforced support components, leading to deformation under gripping force. The connection between the brush main body and grip handle suffers from insufficient fatigue resistance, causing the brush head to bend, deform, or even break during use, severely compromising operational stability and safety.

Regarding functional integration, existing cleaning brush products are limited by single-function design flaws, offering only basic cleaning capabilities. Meanwhile, consumer demand for multifunctional products is growing, creating an urgent need for next-generation products with more innovative features.

SUMMARY

The present disclosure provides a multifunctional cleaning and care brush with a magnetic interlayer to address the issues raised in the background art.

To achieve the above object of the present disclosure, the following technical solutions are adopted:

A multifunctional cleaning and care brush with a magnetic interlayer comprises a main body, a brush structure, a reinforcing structure, and a grip handle. The main body is constructed as a flat plate structure with a working surface and an operating surface, featuring an outer contour that may be oval, disk-shaped, regular polygonal, or a bionic ergonomic curved surface, with edges designed for ergonomic comfort using a combination of rounded and straight transitions. The brush structure is fixedly connected to the working surface of the main body, arranged in a regular equidistant array, with an optimized overall height of 3 mm-5 cm, and made from materials such as medical-grade silicone, high-elasticity rubber, natural plant fibers, or nano-silver antibacterial nylon; specifically it comprises various columns: a stepped column composed of a first column and a second column with different diameters, arranged in a wavy pattern when viewed from the side; a third column with a smooth hemispherical free end; and a fourth column featuring a conical geometric configuration, integrally formed with the working surface of the main body, with specific spacing maintained between adjacent columns. Magnetic fillings are embedded within the working surface of the main body, preferably using ferrite materials, while other embodiments may employ neodymium-iron-boron permanent magnets or flexible rubber magnets. The reinforcing structure is fixedly connected to the operating surface of the main body, comprising radially extending reinforcing ribs arranged in a circumferential array and anti-slip protrusions distributed in a regular array, with the protrusions adopting prismatic or corrugated three-dimensional shapes. The grip handle is connected to the main body via high-temperature extrusion molding, snap-fit, magnetic attraction, universal ball joints, bolts, etc., centrally positioned at the core of the operating surface, with its plane intersecting the extension of the operating surface. The grip handle is perforated with a through hole compatible with common bathroom hooks, and its outer surface may be fitted with a detachable anti-slip sleeve or integrally molded anti-slip bumps.

The beneficial effects of the present disclosure compared to the prior art are:

1. Magnetization and adsorption storage is achieved through magnetic interlayer design, replacing traditional exposed placement and simple hanging hole methods, preventing slipping and tipping caused by wet countertops, while isolating bristles from humid environments to reduce bacterial growth risks.

2. During use, the magnetic filler layer forms a weak static magnetic field, simultaneously promoting microcirculation and providing soothing care to the skin surface during the cleaning process. This endows the cleansing brush with dual composite functions of cleaning and care, breaking through the technical limitations of traditional products that only offer a single cleaning function.

3. The main body is reinforced with ribs, and the anti-slip protrusion design of the grip handle is optimized, addressing the lack of effective support structures in traditional cleaning brushes. This significantly reduces deformation under gripping force, enhances component fatigue resistance, and resolves issues such as bending, breakage, and accidental detachment during use, improving operational safety and structural durability.

BRIEF DESCRIPTION OF DRAWINGS

The drawings, which form part of this application, are provided to further illustrate the present disclosure. The illustrative embodiments and the descriptions thereof are intended to explain the present disclosure and do not constitute an undue limitation thereof. In the drawings.

Figure 1:
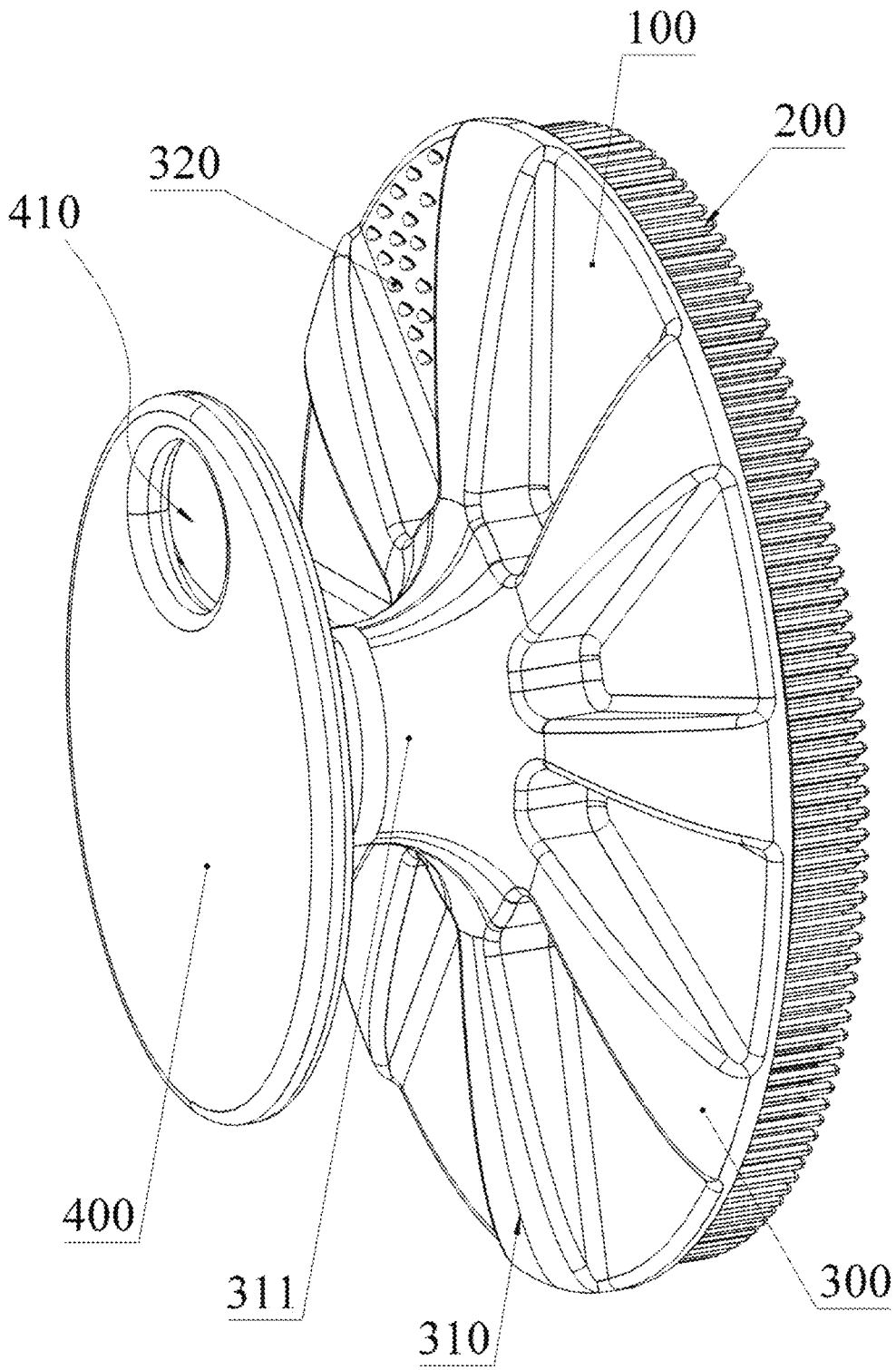
FIG. 1 is a perspective view of an embodiment provided by the present disclosure.

Reference signs: Multifunctional cleaning and care brush with a magnetic interlayer (10); Main body (100); Brush structure (200); First column (210); Second column (220); Third column (230); Fourth column (240); Reinforcing structure (300); Reinforcing rib (310); Extension column (311); Anti-slip protrusion (320); Grip handle (400); Through hole (410); Magnetic filling (500).

DESCRIPTION OF EMBODIMENTS

The technical solution in the embodiment of the present disclosure will be clearly and completely described below with reference to the drawings. Obviously, the described embodiment is part of, rather than all of the embodiments of the present disclosure. The following description of at least one exemplary embodiment is illustrative in nature and is in no way intended to limit the present disclosure, its application or uses. Based on the embodiments in the present disclosure, all other embodiments obtained by those skilled in the art without creative work belong to the scope of protection of the present disclosure.

It should be noted that the terminology used here is only for describing specific embodiments, and is not intended to limit exemplary embodiments according to the present application. As used herein, the singular form is also intended to include the plural form unless the context clearly indicates otherwise. Furthermore, it should be appreciated that when the terms "comprising" and/or "including" are used in this specification, they specify the presence of features, steps, operations, devices, components and/or combinations thereof.

Unless otherwise specified, the relative arrangement of components and steps, numerical expressions and numerical values set forth in these embodiments do not limit the scope of the present disclosure. At the same time, it should be appreciated that for the convenience of description, the dimensions of various parts shown in the drawings are not drawn according to the actual scale relationship. Techniques, methods and equipment known to those skilled in the art may not be discussed in detail, but in appropriate cases, they should be regarded as part of the authorization specification. In all the examples shown and discussed herein, any specific values should be interpreted as illustrative, and not as limiting. Therefore, other examples of exemplary embodiments may have different values. It should be noted that similar numbers and letters indicate similar items in the following drawings, therefore once an item is defined in one drawing, it does not need to be further discussed in subsequent drawings.

In the present disclosure, to address the technical bottlenecks of existing cleaning brushes in terms of storage convenience and connection structural strength, a multifunctional cleaning and care brush with a magnetic interlayer is provided. This cleaning brush achieves stable adhesion to an iron storage rack through the magnetic interlayer. Meanwhile, the main body adopts a radial reinforcing rib and anti-slip protrusion design, combined with high-strength materials such as medical silicone, effectively enhancing structural strength and improving the issues of traditional cleaning brushes being prone to deformation under grip force and insufficient component fatigue resistance. Below, an embodiment of the multifunctional cleaning and care brush with a magnetic interlayer of the present disclosure will be described in detail with reference to the accompanying drawings.

Figure 11:
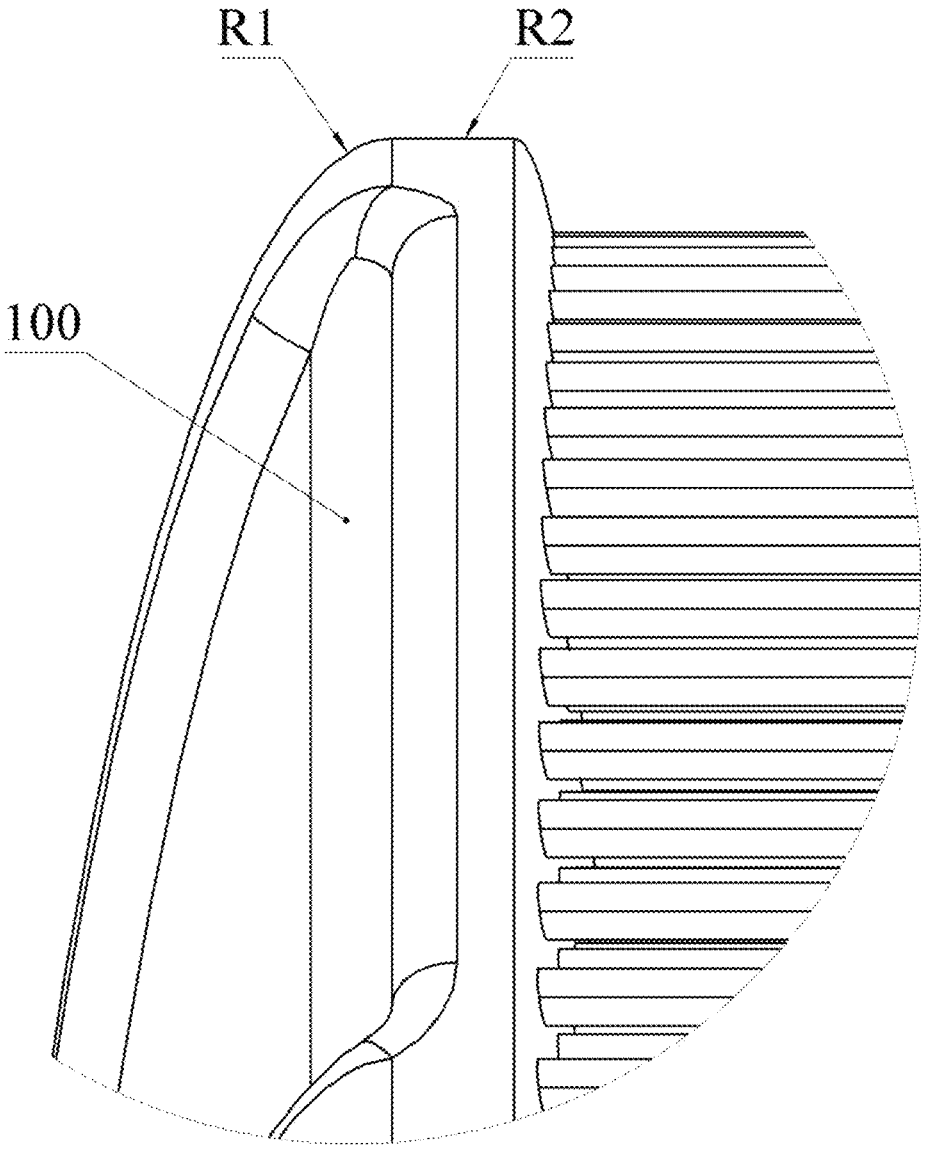
FIG. 11 is a partial schematic view of the main body in the embodiment shown in FIG. 1.

Referring to FIG. 1, the multifunctional cleaning and care brush with a magnetic interlayer 10 in this embodiment includes a main body 100, a brush structure 200, a reinforcing structure 300, and a grip handle 400. The main body 100 is constructed as a flat plate structure with opposing working and operating surfaces, and its outer contour is elliptical. The working surface is designed to carry cleaning functional components, while the operating surface serves as a force-bearing support for user operations. These two surfaces are spatially separated along the thickness direction of the main body. As shown in FIG. 11, the edges of the main body 100 are ergonomically designed with a combination of rounded R1 transitions and straight R2 transitions to accommodate different gripping habits and geometric surface requirements for various cleaning scenarios.

In other embodiments (not shown), the shape of the main body 100 can be customized to a disc shape, regular polygon, or biomimetic ergonomic curved surface based on user needs.

Figure 2:
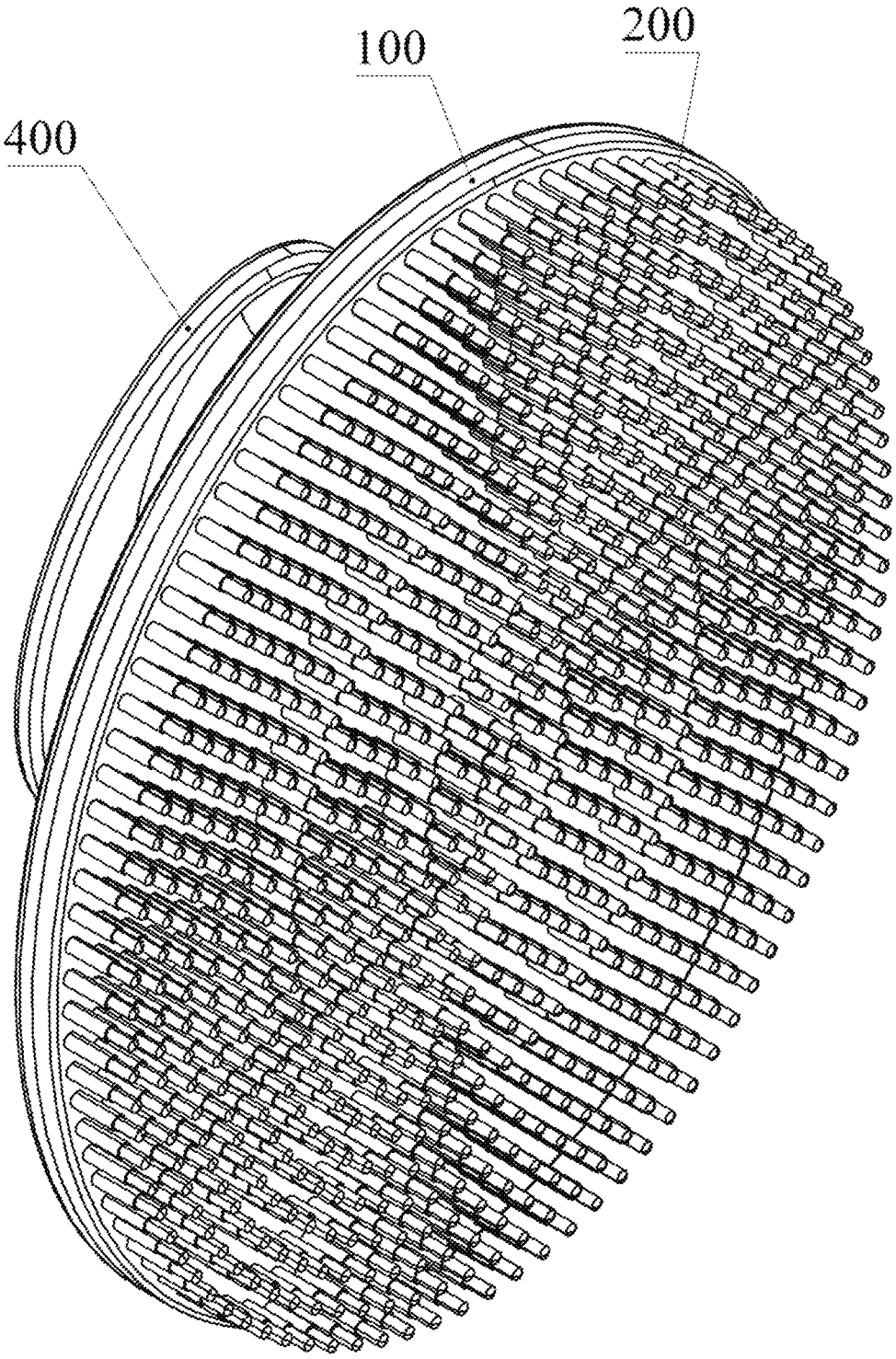
FIG. 2 is a perspective view of the brush structure in the embodiment of FIG. 1.
Figure 3:
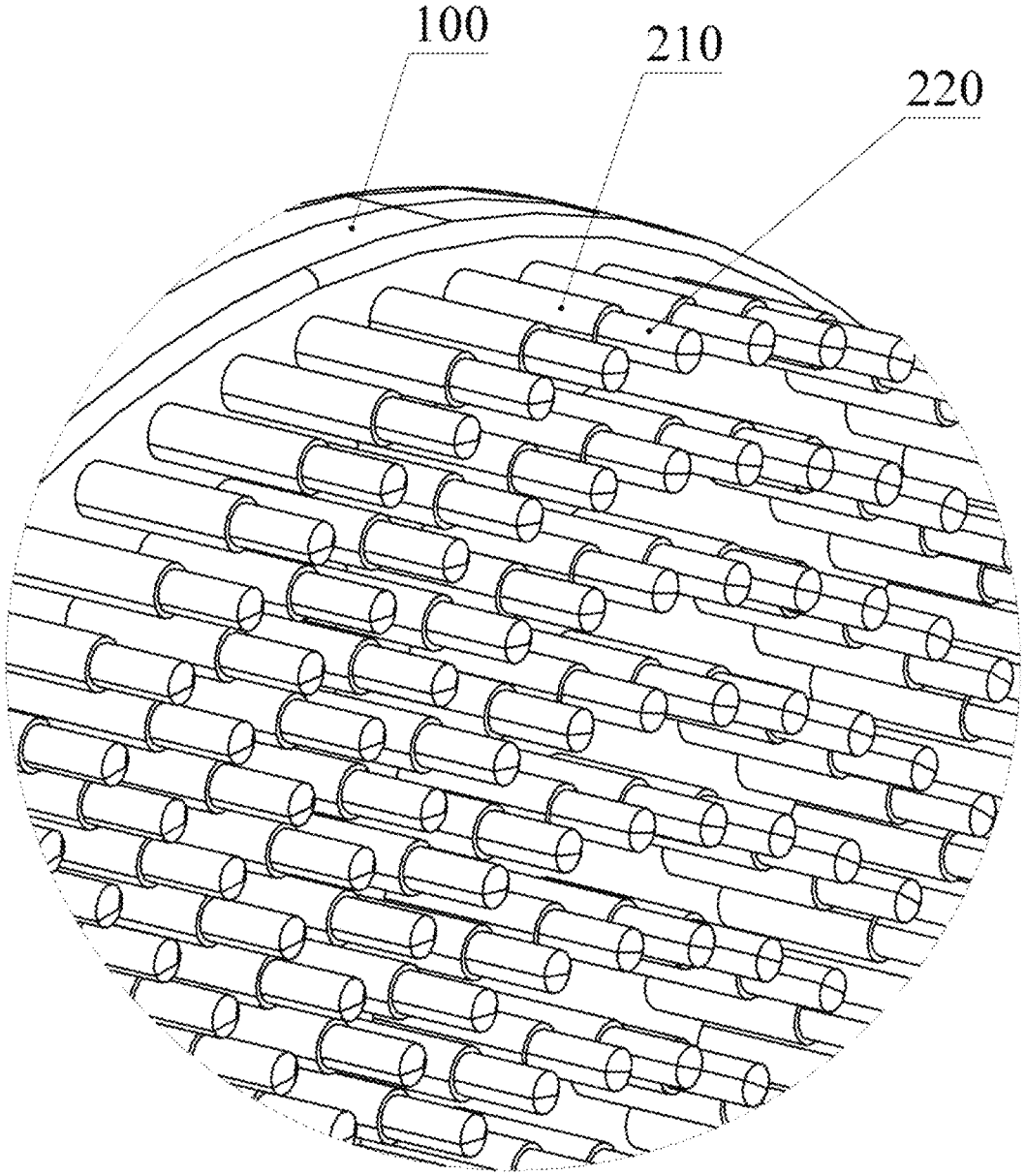
FIG. 3 is a partial schematic view of the brush structure in the embodiment shown in FIG. 2.

Referring to FIGS. 2 and 3, in this embodiment, the brush structure achieves a comfortable massaging effect. It is made of medical-grade silicone or highly elastic rubber, materials known for their excellent flexibility and resilience, which effectively reduce mechanical damage to the skin during cleaning while extending the brush's lifespan and enhancing user experience.

In other embodiments (not shown), the brush structure 200 is not limited to being integrally formed with the working surface but can adopt a modular, detachable design. Specifically, pre-formed brush modules (including stepped, hemispherical, or conical columns) can be detachably connected to the main body 100 via mechanical snaps or slot structures on its working surface. This design ensures rigid fixation through elastic snapping or precise slot embedding, allowing users to switch between modules for shower cleaning, facial care, or hair care as needed, while also facilitating separate cleaning and replacement of brush components.

In other embodiments, the material of the brush structure 200 is not restricted to medical-grade silicone or highly elastic rubber. Options include natural plant fibers, leveraging their inherent antibacterial properties and moderately rough surface for exfoliation; or nano-silver antibacterial nylon, which enhances antimicrobial performance with silver nanoparticles for sensitive areas like the face; or memory foam, offering gentle massage through its pressure-responsive rebound, suitable for sensitive skin; or biodegradable materials such as polylactic acid-based composites, balancing cleaning functionality with environmental sustainability; and thermoplastic elastomers (TPE), whose hardness can be adjusted via formulation to meet diverse cleaning scenario requirements.

Figure 4:
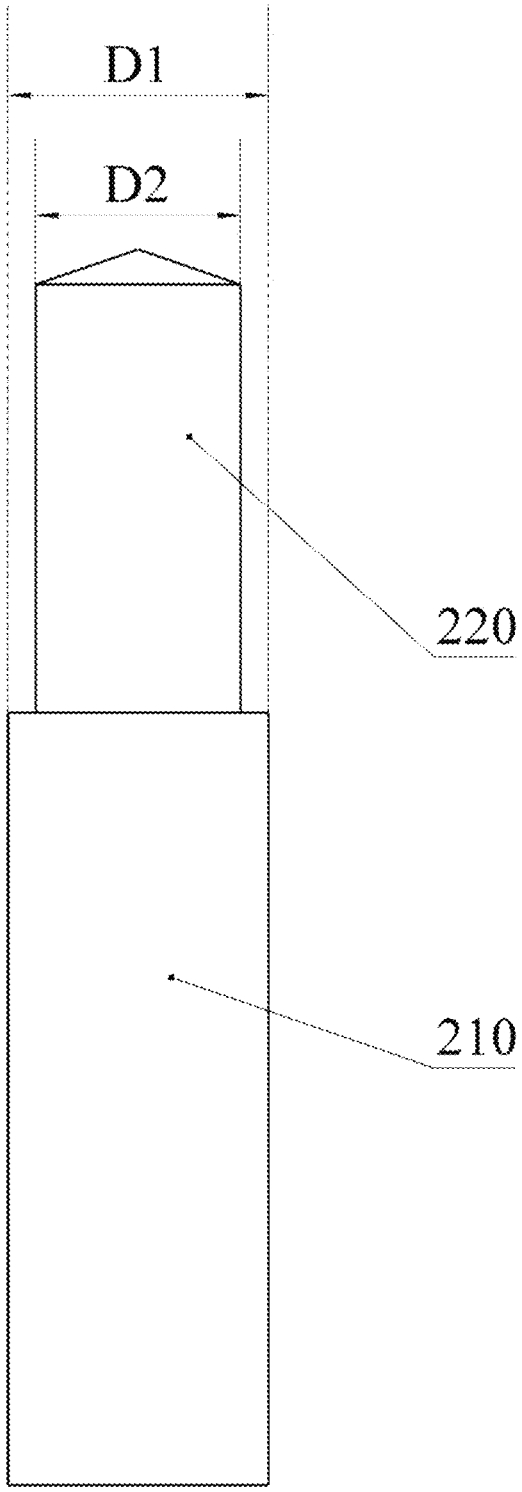
FIG. 4 is a front view of the first column and second column in the embodiment shown in FIG. 3.
Figure 6:
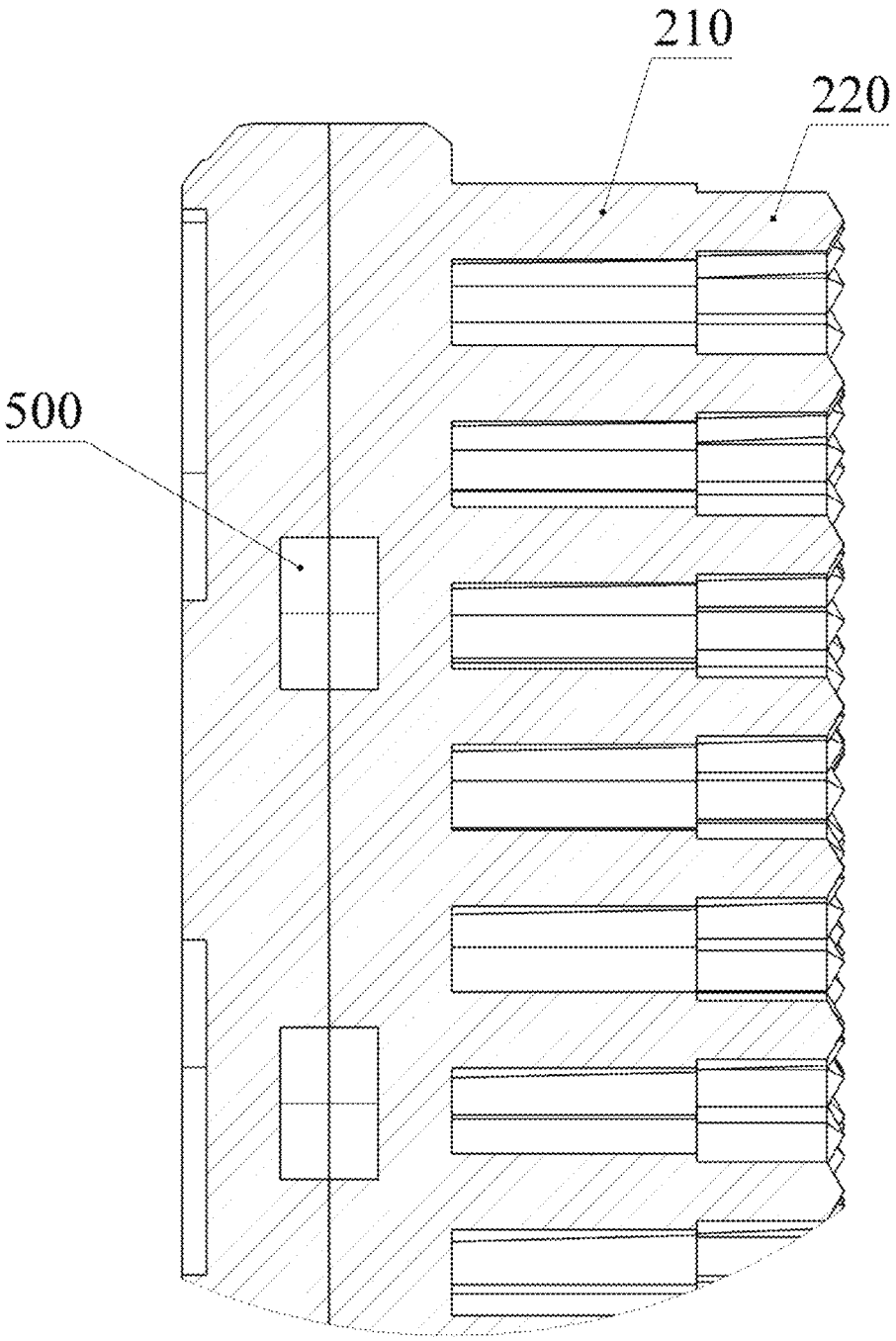
FIG. 6 is a partial schematic view of the embodiment shown in FIG. 5.
Figure 12:
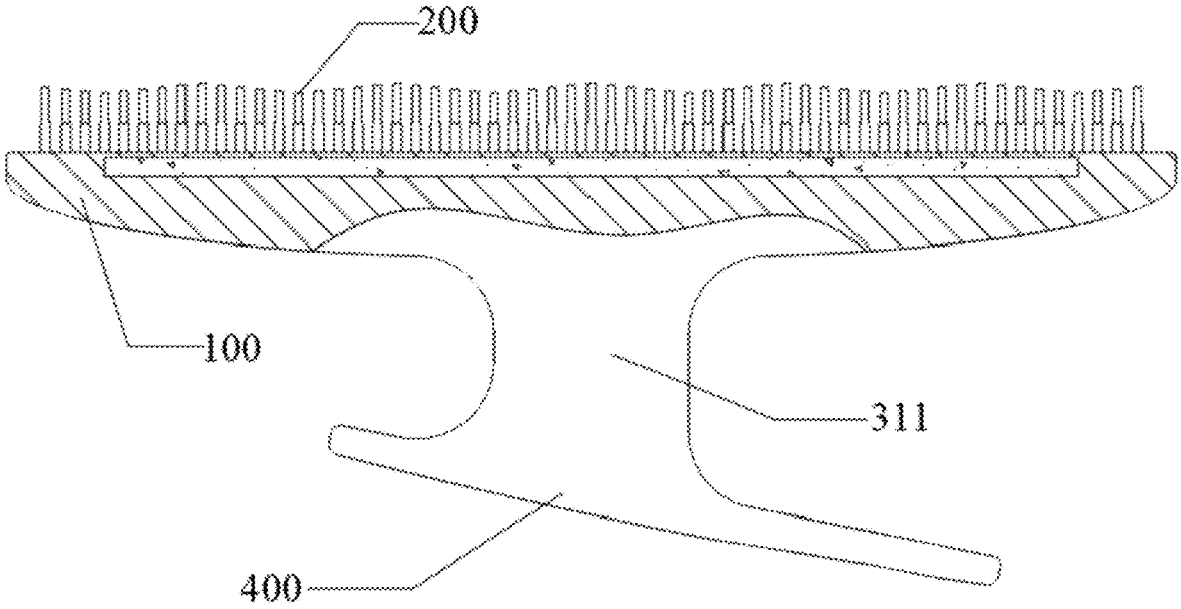
FIG. 12 is a side view of the embodiment shown in FIG. 1.

Specifically, as shown in FIGS. 3 and 6, the brush structure 200 includes a plurality of sets of combined units formed by the first column 210 and the second column 220. These two are integrated into a stepped column structure through a one-piece molding process, where the diameter D1 of the first column 210 is greater than the diameter D2 of the second column 220 (see FIG. 4). This design significantly increases the contact area with large skin surfaces through transitions of varying diameters, effectively enhancing friction during cleaning, making it particularly suitable for showering scenarios. Additionally, when viewed from the side (see FIG. 12), the equidistant array of columns exhibits a regular wavy arrangement, allowing them to closely conform to the curved contours of various body parts. This enables efficient and uniform scrubbing motions during bathing, optimizing cleaning performance and ease of use.

Figure 7:
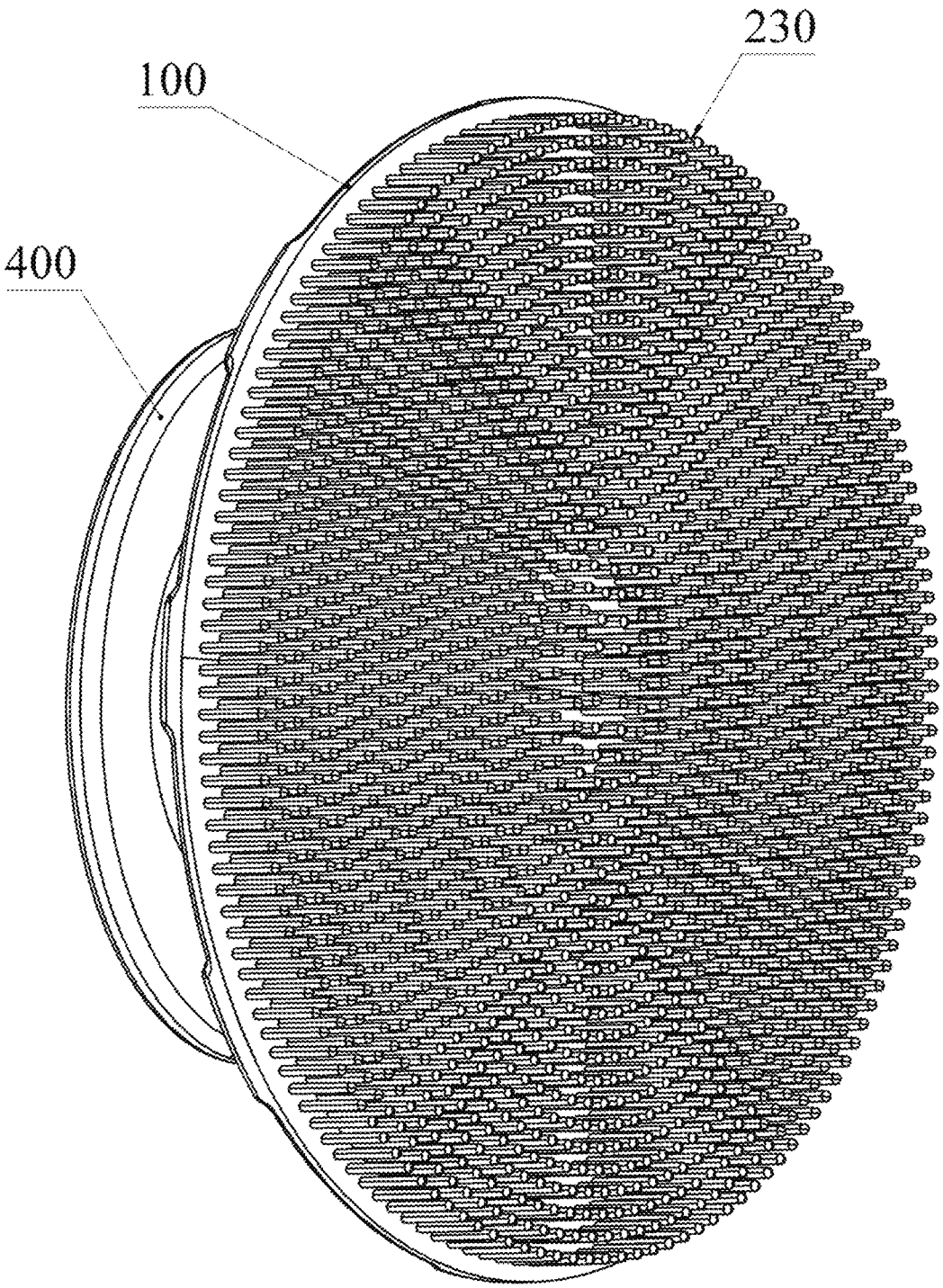
FIG. 7 is a perspective view of another embodiment of the structure shown in FIG. 2.
Figure 8:
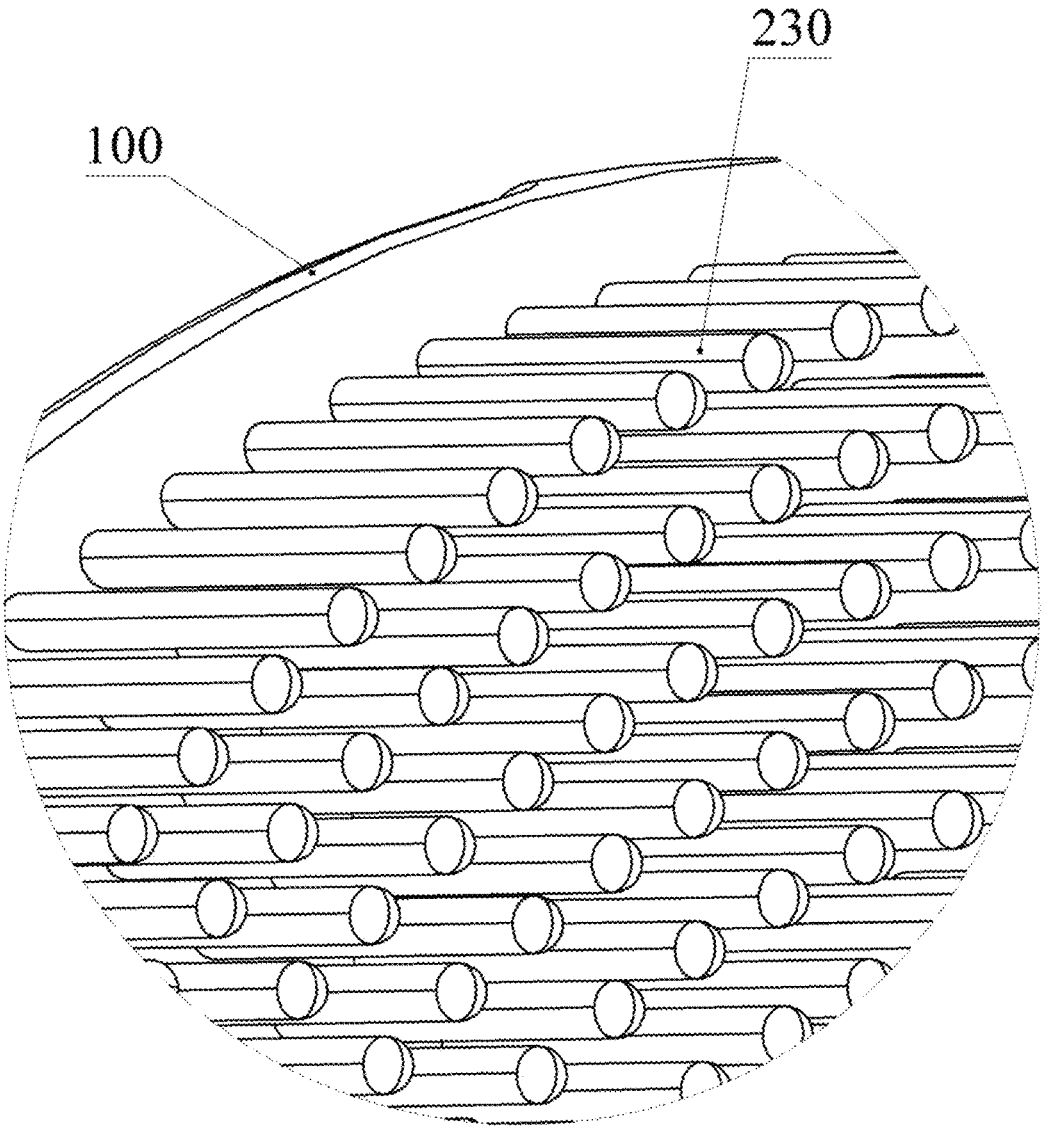
FIG. 8 is a partial schematic view of the brush structure in the embodiment shown in FIG. 7.

In other embodiments, as shown in FIGS. 7 and 8, the brush structure 200 may consist of a plurality of sets of third columns 230, which are arranged in an equidistant array on the working surface of the main body 100, forming uniformly distributed cleaning units. Each third column 230 adopts a consistent diameter design, with its free end shaped into a smooth hemispherical structure. This design effectively avoids skin irritation caused by sharp edges. Thanks to the synergy between the hemispherical curvature and uniform diameter, during facial cleansing, the third columns 230 can contact the skin with gentle and even pressure, reducing friction damage to sensitive skin. This achieves dual functions of mild cleansing and soothing massage, providing users with a comfortable experience tailored to facial care needs.

Figure 9:
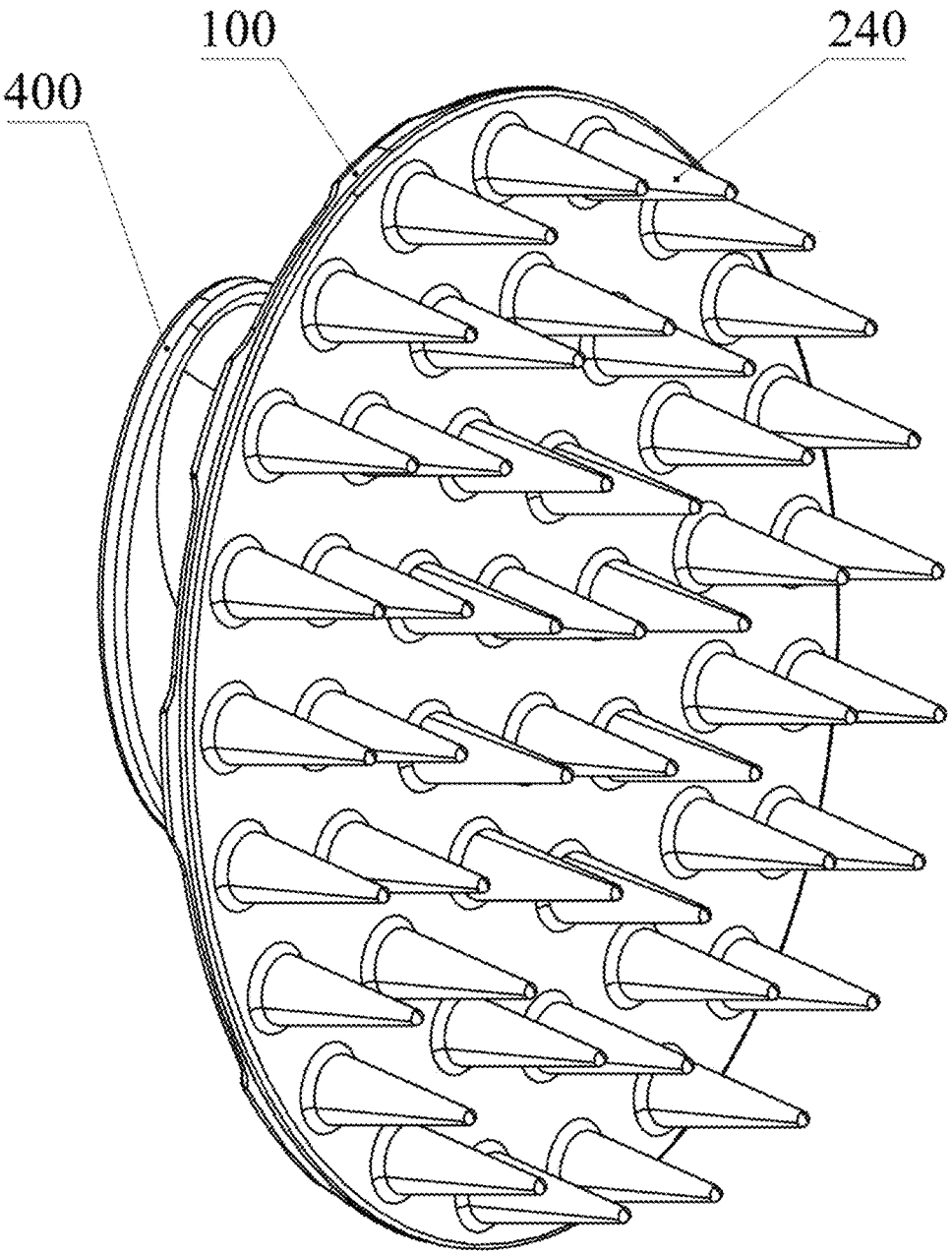
FIG. 9 is a perspective view of another embodiment of the structure shown in FIG. 2.
Figure 10:
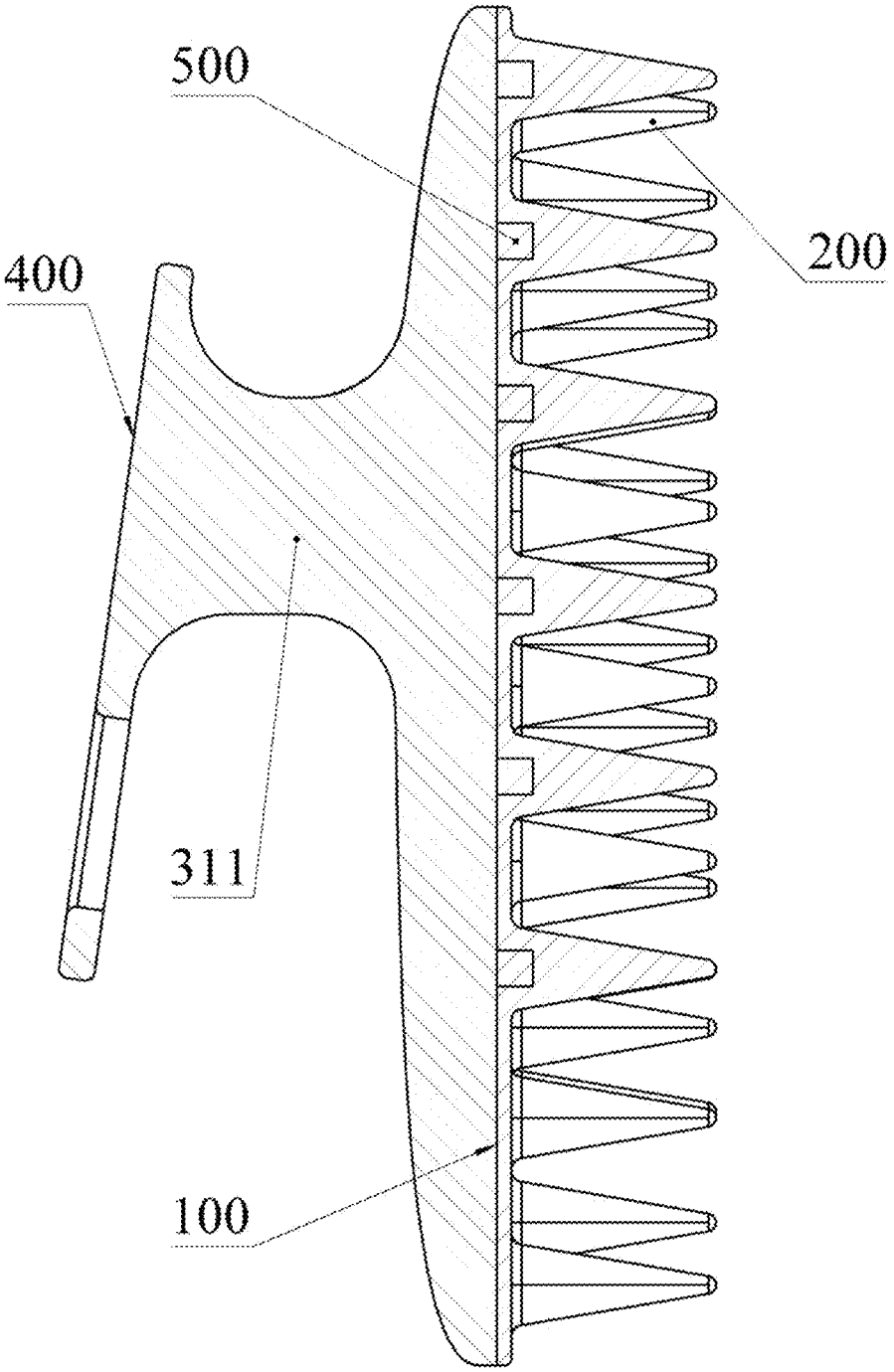
FIG. 10 is a cross-sectional view of the embodiment shown in FIG. 9.

As shown in FIGS. 9 and 10, in another embodiment, the brush structure 200 may also consist of a plurality of sets of fourth columns 240, each featuring a conical geometric configuration and fixed to the working surface of the main body 100 via a one-piece molding process. The fourth columns 240 are arranged in a sparse array on the working surface, maintaining specific spacing between adjacent columns. This ensures effective coverage during cleaning while minimizing the risk of hair entanglement. During hair washing, the conical tips can penetrate deep into the hair roots, effectively removing scalp dirt and oil. Simultaneously, the conical structure helps comb through hair strands when sliding along them, untangling knotted hair. This dual functionality of cleansing and detangling makes it particularly suitable for long or easily tangled hair care scenarios.

Figure 5:
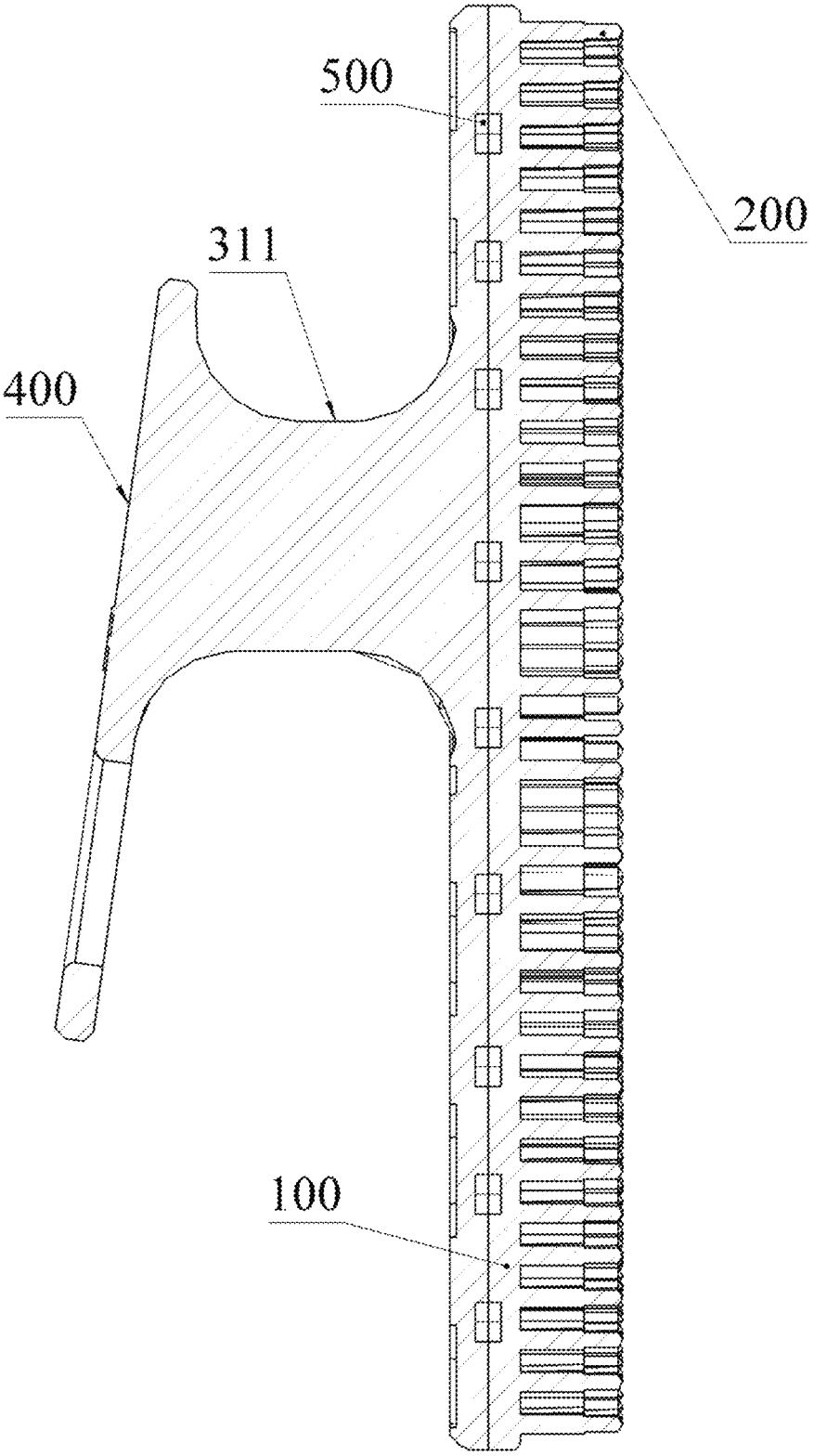
FIG. 5 is a cross-sectional view of the embodiment shown in FIG. 2.

As shown in FIG. 5, the magnetic filler 500 is embedded within the working surface of the main body 100 and fully covers the projection area of the working surface. In a preferred embodiment, ferrite is selected as the filler material. When in contact with the skin, ferrite generates a weak static magnetic field, which promotes blood circulation in the contact area through magnetic field effects, helping to alleviate subtle tension in the skin's surface. Its mechanism of action is similar to that of magnetic therapy stones in improving human microcirculation. While cleansing the skin, it also aids in enhancing the metabolic efficiency of the skin's surface through continuous, gentle magnetic field effects, offering users a dual experience of both cleansing and care.

Additionally, ferrite possesses magnetizable properties. After cleaning tasks are completed, it can be magnetized by an external device, enabling a strong bond with an iron storage rack. When magnetized, the magnetic filler layer forms a full-range adsorption force field across the working surface. Here, the full-range adsorption force field refers to the magnetic attraction force covering the entire area of the main body's working surface, achieved through the uniform distribution and magnetization of the magnetic filler material. This ensures that the cleansing brush generates balanced adsorption force when contacting any part of the iron storage rack, eliminating dead zones or localized stress concentrations during adsorption. This guarantees stable positioning during storage, preventing slipping or tipping, thereby optimizing bathroom storage convenience and space utilization efficiency. This solution, combining functional magnetic therapy effects with practical storage design, not only enhances product comfort but also adds potential health care value, aligning with the trend toward multifunctional modern bathroom products.

In other embodiments, the magnetic filler 500 can also be made from alternative materials, such as neodymium-iron-boron permanent magnets, which offer higher magnetic energy product and stronger adsorption force. Alternatively, flexible rubber magnets can be used, as they can bend and deform to fit curved main bodies while combining magnetic and elastic properties, further improving skin contact comfort.

As shown in FIG. 1, the reinforcing structure 300 is fixedly connected to the operating surface of the main body 100 to enhance its support strength. This ensures that the cleansing brush can better withstand pressure during use without significant deformation, thereby extending the overall lifespan of the brush.

Specifically, the reinforcing structure 300 includes a plurality of sets of reinforcing ribs 310 distributed in a circumferential array on the operating surface of the main body 100. In the preferred embodiment, the reinforcing ribs 310 and the main body 100 are integrally formed through high-temperature extrusion, ensuring reliable structural connection. Several reinforcing ribs 310 extend radially from the geometric center of the operating surface as the intersection point, where an extension column 311 is fixed, forming a divergent support framework. As a support assembly, the extension column 311 evenly transmits the force on the operating surface to each reinforcing rib, effectively dispersing stress concentration during gripping and cleaning, significantly enhancing the anti-deformation capability of the operating surface and the overall structural strength of the cleaning brush, providing users with stable operational support.

In other embodiments (not shown), a diversion groove structure can be added at the end of the reinforcing ribs 310. This groove extends along the length direction of the reinforcing rib and features a concave inclined design. When the cleaning brush is placed at an angle, water can quickly flow along the groove to the edge of the main body and drip off. This design effectively prevents water accumulation on the back of the main body, reducing the risk of material aging and bacterial growth due to prolonged dampness. Combined with the natural drainage of the brush structure, it further improves the product's durability and hygiene performance.

In other embodiments (not shown), the reinforcing ribs 310 can also be fixed to the main body 100 through alternative connection methods. For example, a snap-fit connection can be used, where the elastic snap at the bottom of the reinforcing rib is inserted into a preformed slot on the main body for mechanical locking. Alternatively, a magnetic connection can be employed, with permanent magnets and magnetic-conductive components placed at the root of the reinforcing rib and corresponding positions on the main body. Threaded fastening is another option, where the stud at the bottom of the reinforcing rib is screwed into a threaded hole on the main body. These various connection methods balance structural strength and assembly flexibility.

Referring to FIG. 1, the reinforcing structure 300 also includes anti-slip protrusions 320 integrally formed on the operating surface of the main body 100. These protrusions are distributed in a regular array between adjacent two sets of reinforcing ribs 310, forming a complete anti-slip surface through optimized spacing and layout design. The anti-slip protrusions 320 adopt prismatic or corrugated three-dimensional shapes, significantly increasing the contact area with the palm. During use, even when coated with lubricants like shower gel or soap, the protrusions effectively enhance friction between the hand and the main body 100, reducing the risk of slipping and ensuring stable grip in various cleaning scenarios, thereby improving safety and ease of use.

Referring to FIGS. 1 and 5, in this embodiment, the grip handle 400 is integrally formed with the extension column 311 through a high-temperature extrusion molding process. It is rigidly connected to the main body 100 via the extension column 311, ensuring structural stability and integrity while providing users with a comfortable and reliable handheld operation experience. The grip handle 400 is centrally positioned at the operating surface of the main body 100, with its plane intersecting the extended surface of the operating surface, making it easier to grip during use and allowing better force application through the angled surface when assisted by others. This positional design, combined with the reinforcing ribs 310 arranged in a circumferential array and the anti-slip protrusions 320, forms a synergistic support system. This layout effectively disperses stress during use, significantly enhancing the structural strength and deformation resistance of the main body 100. Additionally, the positioning of the grip handle 400 functionally interacts with the diverse brush structure 200, enabling precise control whether for densely arranged shower brush sets, conical shampoo bristles, or hemispherical facial cleaning units. This meets the functional demands of various washing and care scenarios, greatly improving the adaptability and user experience of the cleaning brush.

In other embodiments (not shown), to further optimize grip comfort and anti-slip performance, the outer surface of the grip handle 400 can be fitted with a detachable anti-slip sleeve. This sleeve is made of elastic materials such as silicone or rubber, featuring wave or granular textures to effectively increase friction. Alternatively, anti-slip bumps can be integrally molded onto the surface of the grip handle 400 via injection molding, arranged in a matrix or spiral pattern to provide stable grip even in wet conditions, particularly suitable for use during bathing when hands are wet.

In other embodiments (not shown), the connection between the grip handle 400 and the extension column 311, besides being integrally formed, can adopt a snap-fit design. Elastic hooks are arranged on the inner wall of the grip handle 400 to precisely engage with pre-molded annular grooves on the outer periphery of the extension column 311, enabling quick assembly and disassembly. Alternatively, a universal ball joint structure can be used, where the top of the extension column 311 is designed as a sphere to fit into a hemispherical recess within the grip handle 400, allowing multi-angle free rotation of the handle to accommodate different gripping postures. Another option is bolt fastening, where a threaded hole is created inside the extension column 311, and a corresponding stud is set at the bottom of the grip handle 400, achieving rigid fixation through rotation and tightening. Magnetic connection is also feasible, with permanent magnets and magnetically conductive metal plates embedded at the contact ends of the grip handle 400 and the extension column 311, respectively, ensuring a stable connection via magnetic attraction while facilitating easy disassembly and replacement. These diverse connection methods not only meet structural strength requirements but also provide flexible assembly and usage features, allowing users to replace grip handles of different sizes as needed.

In this embodiment, referring to FIG. 1, the grip handle 400 is perforated with a through hole 410, the diameter of which is compatible with common bathroom hooks. The hole is preferably positioned near the free end of the grip handle. This design enables the care brush to be conveniently hung on bathroom wall hooks, shower rods, etc., not only saving counter space but also allowing gravity to naturally drain moisture from the brush structure, reducing the risk of bacterial growth while enhancing the tidiness and accessibility of bathroom storage.

In other embodiments (not shown), a magnetic hanging ring assembly can be embedded in the through hole 410. This ring adopts an integrated design of permanent magnets and a metal ring, fixed to the inner wall of the through hole via interference fit or adhesive. During use, the magnetic ring can directly attach to magnetically conductive surfaces such as bathroom metal hooks or stainless steel storage racks, eliminating the need for additional drilling or snap-fit fixtures. This ensures stable hanging while allowing flexible angle adjustments. Moreover, the detachable nature of the magnetic connection enables users to replace rings of different specifications as needed, adapting to diverse storage scenarios and further enhancing the product's practicality and spatial compatibility.

In summary, the present disclosure achieves the following technical effects: the magnetic filler 500 is embedded within the working surface of the main body 100, and its magnetizable property enables stable adhesion to an iron storage rack, effectively addressing issues such as slippery surfaces due to traditional exposed placement and bacterial growth from brush bristles contacting damp environments; simultaneously, the weak static magnetic field generated by the magnetic filler 500 promotes skin microcirculation during cleaning; the main body 100, through the three-dimensional texture design of radial reinforcing ribs 310 and anti-slip protrusions 320, constructs a rigid support system, resolving the problem of deformation under force during gripping with traditional care brushes; combined with high-strength materials such as medical silicone and nano-silver antibacterial nylon, it enhances component fatigue resistance, reduces bending deformation, breakage, or accidental detachment of the brush head during use, and improves operational stability.

In the description of the present disclosure, it should be appreciated that directional terms such as "front, rear, up, down, left, right", "horizontal, vertical, perpendicular, horizontal" and "top, bottom" etc. indicate the orientation or positional relationship based on the orientation or positional relationship shown in the drawings, and are only for the convenience of describing the present disclosure and simplifying the description. In the absence of a contrary explanation, these directional terms do not indicate or imply that the device or element referred to must have a specific orientation or be constructed and operated in a specific orientation, and therefore should not be understood as limiting the scope of protection of the present disclosure; the directional terms "inside, outside" refer to the inside and outside relative to the contour of each component itself.

For the convenience of description, spatial relative terms such as "on . . . ", "above . . . ", "on the upper surface of . . . ", "upper" etc. may be used here to describe the spatial positional relationship of a device or feature with other devices or features as shown in the drawings. It should be appreciated that spatial relative terms are intended to encompass different orientations of the device in use or operation other than the orientation described in the drawings. For example, if the device in the drawing is inverted, the device described as "above other devices or structures" or "on other devices or structures" will subsequently be positioned as "below other devices or structures" or "under other devices or structures". Thus, the exemplary term "above" can include both "above" and "below" orientations. The device can also be positioned in other different ways (rotated 90 degrees or in other orientations), and the spatial relative descriptions used here should be interpreted accordingly.

In addition, it should be noted that the use of terms such as "first", "second" etc. to define components is for the convenience of distinguishing the corresponding components. Unless otherwise stated, the above terms have no special meaning, and therefore should not be understood as limiting the scope of protection of the present disclosure.

The above description is only a preferred embodiment of the present disclosure and is not intended to limit the present disclosure. For those skilled in the art, the present disclosure can have various modifications and changes. Any modifications, equivalent replacements, improvements etc. made within the spirit and principles of the present disclosure should be included within the scope of protection of the present disclosure.

What is claimed is:

1. A multifunctional washing and care brush, comprising a main body, a brush structure, a reinforcing structure, and a grip handle, wherein the main body has a plate structure, which has a working surface and an operating surface arranged opposite each other; and the brush structure is fixedly connected to the working surface of the main body and comprises a plurality of cleaning units arranged in an array along the working surface; and the main body has a magnetic filler layer embedded within the working surface, the magnetic filler layer comprising at least a portion of a magnet; and the reinforcing structure comprises:

a plurality of reinforcing ribs distributed radially, each reinforcing rib extending outward from a geometric center of the operating surface as an intersection point and integrally connected with an extension column at the intersection point; and the grip handle is rigidly connected to the extension column.

2. The multifunctional washing and care brush according to claim 1, wherein the brush structure comprises a stepped column that have a first column and a second column, which is suitable for bathing scenarios.

3. The multifunctional washing and care brush according to claim 2, wherein a diameter of the first column is greater than that of the second column.

4. The multifunctional washing and care brush according to claim 2, wherein adjacent column units are arranged in a wavy pattern.

5. The multifunctional washing and care brush according to claim 1, wherein the reinforcing structure comprises a plurality of anti-slip protrusions arrayed in an area of the operating surface between adjacent two sets of reinforcing ribs.

6. The multifunctional washing and care brush according to claim 1, wherein a central axis of the grip handle coincides with the geometric center of the operating surface.

7. The multifunctional washing and care brush according to claim 1, wherein the reinforcing ribs have grooves, the grooves being set on the surfaces of the reinforcing ribs and extending along a length direction thereof.

8. The multifunctional washing and care brush according to claim 7, wherein a cross-section of the grooves is concave arc-shaped for guiding liquid flow toward an edge of the main body.

9. The multifunctional washing and care brush according to claim 1, wherein the grip handle comprises an anti-slip sleeve detachably arranged on an outer surface of the grip handle, the anti-slip sleeve having a spiral raised texture.

10. A multifunctional cleaning and care brush, comprising a main body, a brush structure, a reinforcing structure, and a grip handle, wherein the main body has a plate structure, which has a working surface and an operating surface arranged opposite each other; and the brush structure is fixedly connected to the working surface of the main body and comprises a plurality of cleaning units arranged in an array along the working surface; and the main body has a magnetic filler layer embedded within the working surface, and the magnetic filler layer comprises at least one magnet; and the reinforcing structure comprises:

a support assembly disposed on the operating surface;

wherein the grip handle is rigidly connected to the main body via the support assembly for transmitting a gripping force to the working surface.

11. The multifunctional cleaning and care brush according to claim 10, wherein the brush structure comprises hemispherical columns suitable for facial care scenarios.

12. The multifunctional cleaning and care brush according to claim 10, wherein a geometric centerline of the support assembly coincides with a centerline of the grip handle.

13. The multifunctional cleaning and care brush according to claim 12, wherein the support assembly comprises a plurality of reinforcing ribs distributed radially.

14. The multifunctional cleaning and care brush according to claim 13, wherein each reinforcing rib extends outward from the geometric center of the operating surface as an intersection point and is integrally connected with an extension column at the intersection point.

15. The multifunctional cleaning and care brush according to claim 14, wherein the reinforcing structure comprises a universal ball assembly, and the grip handle is connected to the extension column via the universal ball assembly to enable multi-angle adjustment of the grip handle.

16. The multifunctional cleaning and care brush according to claim 10, wherein the reinforcing structure has a plurality of prism-shaped anti-slip protrusions.

17. A multifunctional cleaning and care brush, comprising a main body, a brush structure, a reinforcing structure, and a grip handle, wherein the main body has a plate structure, which comprises a working surface and an operating surface arranged opposite each other; and the brush structure is fixedly connected to the working surface of the main body and comprises a plurality of cleaning units arranged in an array along the working surface; and the main body has a magnetic filler layer embedded within the working surface, which is composed of a rechargeable magnetic material and fully covers a projection area of the working surface; and the reinforcing structure comprises:

a support assembly arranged on the operating surface;

wherein the grip handle is rigidly connected to the main body via the support assembly to transmit a gripping force to the working surface, and the magnetic filler layer forms a full-range adsorption force field on the working surface when magnetized, enabling adsorption and fixation with an iron storage rack.

18. The multifunctional cleaning and care brush according to claim 17, wherein the brush structure comprises a cone-shaped main body, suitable for hair care scenarios.

19. The multifunctional cleaning and care brush according to claim 17, wherein the grip handle has a through hole for connecting to a bathroom hook.

20. The multifunctional cleaning and care brush according to claim 19, wherein a magnetic hanging ring assembly is embedded in the through hole.

* * * * *